US007051948B2

(12) United States Patent
Wa

(10) Patent No.: US 7,051,948 B2
(45) Date of Patent: May 30, 2006

(54) FLEXIBLE TRACK FOR A TOY VEHICLE

(75) Inventor: Choi Man Wa, Fanling (HK)

(73) Assignee: Battat Incorporated, Plattsburgh, NY (US)

( * ) Notice: Subject to any disclaimer, the term of this patent is extended or adjusted under 35 U.S.C. 154(b) by 1 day.

(21) Appl. No.: 10/686,368

(22) Filed: Oct. 14, 2003

(65) Prior Publication Data

US 2004/0182947 A1 Sep. 23, 2004

Related U.S. Application Data

(63) Continuation-in-part of application No. 10/266,526, filed on Oct. 8, 2002, now Pat. No. 6,631,850.

(51) Int. Cl.
*E01B 23/00* (2006.01)

(52) U.S. Cl. ..... 238/10 E; 238/10 A; 238/10 R

(58) Field of Classification Search ..... 238/10 R, 238/10 E, 10 F, 15; 104/53, 60; 446/444, 446/448

See application file for complete search history.

(56) References Cited

U.S. PATENT DOCUMENTS 3,000,573 A * 9/1961 Schlau ..... 238/10 R
3,424,379 A * 1/1969 Giammarion et al. ..... 238/10 R
3,680,777 A * 8/1972 Arai ..... 238/10 E
4,540,119 A * 9/1985 Neuhierl ..... 238/10 R
4,941,610 A * 7/1990 Frauca ..... 238/10 A
5,160,091 A * 11/1992 Hesse ..... 238/10 E
6,382,519 B1 * 5/2002 Choi ..... 238/10 R
6,631,850 B1 * 10/2003 Wa ..... 238/10 F

* cited by examiner

*Primary Examiner*—Frantz F. Jules
(74) *Attorney, Agent, or Firm*—Andrew S. Langsam; Levisohn, Berger & Langsam LLP

(57) ABSTRACT

A track for a toy vehicle and such vehicle are provided. Each track segment has an upper layer and a spaced apart lower layer. A pivot pin is vertically disposed on a forwardly projecting tongue attached to one of the upper and lower layers, and a rearwardly disposed crossbar is adapted to receive the pivot pin of an adjacent segment. By repeating this pivotably angled structure with a number of segments, the curvature of the track can be altered to the taste and specifications of the user. A pair of flanges project from the top side and form a channel. A toy vehicle engageable with the track includes a retaining knob on its base that is forcibly disposable in the channel. When the retaining knob is forcibly disposed in the channel, the vehicle is retained on the track substantially regardless of angle of inclination or curvature of the track.

17 Claims, 7 Drawing Sheets

FLEXIBLE TRACK FOR A TOY VEHICLE

RELATED APPLICATIONS

This is a continuation-in-part of U.S. patent application Ser. No. 10/266,526 filed on Oct. 8, 2002, now U.S. Pat. No. 6,631,850 issued Oct. 14, 2003.

BACKGROUND OF THE INVENTION

1. Field of the Invention

The present invention relates to a flexible toy track. More specifically, the present invention relates to a flexible track for a toy vehicle having interlinking components, providing an angle to each track segment with respect to its adjacent track segments so as to selectively curve the track in three dimensions (e.g., up and down as well as left and right).

2. Description of Related Art

For many years, toy trains have been popular, especially among children. Frequently, toy trains are constructed to run along a toy train track. A number of different types of children's toy train tracks have been suggested in the past. These train tracks typically have sections of wood, plastic, or metal which are straight or curved and which can be interconnected by the child to form a circuitous toy train track along which a toy train can be rolled without interruption on the track. In one conventional arrangement, a first track section having a tongue at one end is connected by mating the tongue to a receiving slot or groove in a second track section, and this arrangement repeats for the length of the train track. This arrangement generally does not allow for significant flexibility in the construction of a closed loop train track. One problem arises in that the standard curved track has a fixed radius of curvature; it is difficult to create an interesting and closed loop when one has a finite number of choices of curved sections from which to choose. Other structures for interconnecting train tracks that have been used in the past have generally been found to be overly complicated or do not provide a mechanism for retaining the train track segments in a selected position of curvature.

Additionally, there has not been provided a mechanism for allowing a toy train track to curve upwards off the surface the track is disposed on or downward therefrom. Train tracks in real life are not limited to a flat two-dimensional configuration; rather, they can conform to the topography of land and/or be supported above portions of land on trestles. Tracks in real life thus include inclines and declines.

There is a need for a toy train track that is simple in construction and allows for flexibility in the connection between adjoining train track sections so as to allow the user playing with the track to arrange it in different curvatures as desired while maintaining continuity of the track sections and allowing the track to vary in height. It is also desired to provide a toy train track and corresponding vehicle that will allow the vehicle to travel upside-down on the track like a modern roller coaster.

One prior design that has proven effective for allowing for selectable two-dimensional curvature of a toy vehicle track is the predecessor to the instant invention, which is described in U.S. Pat. No. 6,631,850 to Wa (the instant inventor) and which is assigned to the instant assignee, the entire teachings of which are fully incorporated by reference herein and from which priority is claimed herein. Yet even the prior Wa patent does not teach a train track that can leave the surface of a flat plane upon which the track is disposed and be bent into loops, twists, and other similar shapes.

SUMMARY OF THE INVENTION

An object of the present invention is to provide a track for a toy vehicle that allows for flexibility in the curvature and connection between adjoining train tracks.

Another object of the present invention is to provide a track for a toy vehicle that may be manipulated by the user to form different curvatures.

Another object of the present invention is to provide a simple mechanism for maintaining a track segment in a curved position relative to adjacent track segments, while maintaining contiguity of the track sections so that a train can pass thereover without derailment.

Another object of the present invention is to provide a track for a toy vehicle that can curve off of the surface the track is disposed upon.

Another object of the present invention is to provide a track for a toy vehicle that can loop and twist without causing the vehicle to be thrown from the track.

The above and other objects are fulfilled by the invention, which is a track for a toy vehicle and optionally the corresponding vehicle. The inventive track, capable of being curved into a wide variety of curves, includes a plurality of connectable segments. Each of the segments includes an upper layer having a top side for supporting a toy vehicle and a bottom side and a lower layer spaced apart from the upper layer. A pivot pin is vertically disposed on a forwardly projecting tongue attached to one of the upper and lower layers. A rearwardly disposed crossbar is provided to receive the pivot pin of a rearwardly adjacent segment. Forwardly projecting prongs engage the bottom side of a forwardly adjacent segment. Friction between the prongs and the bottom side of the forwardly adjacent segment deters free relative motion between adjacent of the segments. The prongs have a flat upper surface for engaging the bottom side of the upper layer of the adjacent segment. Preferably, a notch is formed in a forward edge of the crossbar adapted to receive the pivot pin of an adjacent of the segments.

The joint formed by the pivot pin and the crossbar is made in a manner to allow for bending between two segments in a curvature off of the plane of the track. An upper tongue portion projects from the upper layer, and a lower tongue portion projects from the lower layer aligned opposite the upper tongue portion. The pivot pin projects from one of the upper tongue portion and lower tongue portion and wherein the crossbar is adapted to be secured between the upper tongue portion and lower tongue portion. Projections are formed on the other of the upper tongue portion and lower tongue portion opposite and on either side of the pivot pin.

The inventive track also includes a pair of raised flanges projecting upward from the top side spaced apart to form a channel, which is disposed over the tongue portion of the segments. The flanges include a substantially vertical portion projecting from the top side of the track and a substantially horizontal portion projecting over the channel. The flanges are preferably made of a resilient material such as plastic. When a retaining knob from a toy vehicle is forcibly disposed into the channel, the flanges are pushed apart to allow the retaining knob into the channel and snap back to secure the retaining knob in the channel.

The segments are made longitudinally thicker in the center than they are at their sides, which allows them the room to pivot with respect to one another and thus create a track with selective curvature. Also, the rearward portion of each segment includes a cutout forward of the crossbar adapted to receive a tongue from a rearward adjacent segment. Because the cutout is provided, the tongue can pivot up and down as well as from side to side, thus allowing the track to curve upwards or downwards as well as left and right.

The track also includes side supports projecting from the sides of at least one of the segments, wherein the track is supportable above a planar surface at the side supports.

The invention also includes a toy vehicle for use with a track as described above. The inventive toy vehicle includes a base and wheels adapted to contact the top side of the track to allow the vehicle to roll on the track. A retaining knob projects from an underside of the base and is forcibly disposable in the channel. When the retaining knob is forcibly disposed in the channel, the vehicle is retained on the track substantially regardless of angle of inclination or curvature of the track.

The invention also includes a combination track and toy vehicle which may be sold/provided as a set. The track has a plurality of segments, and each segment includes: an upper layer having a top side for supporting a toy vehicle and a bottom side and a lower layer spaced apart from the upper layer. A pivot pin is vertically disposed on a forwardly projecting tongue attached to one of the upper and lower layers, and a rearwardly disposed crossbar is adapted to receive the pivot pin of a rearwardly adjacent segment. A pair of raised flanges project upward from the top side spaced apart to form a channel. A toy vehicle engageable with the track includes a base and wheels adapted to contact the top side of the track to allow the vehicle to roll on the track. A retaining knob projects from an underside of the base and is forcibly disposable in the channel. When the retaining knob is forcibly disposed in the channel, the vehicle is retained on the track substantially regardless of angle of inclination or curvature of the track. The flanges are preferably made of a resilient material. When the retaining knob is forcibly disposed into the channel, the flanges are pushed apart to allow the retaining knob into the channel and snap back to secure the retaining knob in the channel.

The prongs of one segment are engageable with the underside of the top layer of the next so as to prevent the segments from freely flopping around with respect to each other. That is, a certain amount of force is required to overcome the friction between adjacent segments. By repeating this pivotably angled structure among a number of segments, the curvature of the track can be altered to the taste and specifications of the user. The angle between two segments (and, by extension, the curvature of the overall track) is thus "set" and only adjustable with the application of force; that is, the various segments of the inventive track do not flop around freely and loosely but rather retain their relative positions unless positioned differently by the user.

DETAILED DESCRIPTION OF THE PREFERRED EMBODIMENT AND THE DRAWINGS

Description will now be given of the invention with reference to the attached FIGS. 1–12B. It should be noted that these drawings are exemplary in nature and in no way serve to limit the scope of the invention, which is defined by the claims appearing herein below.

Figure 1:
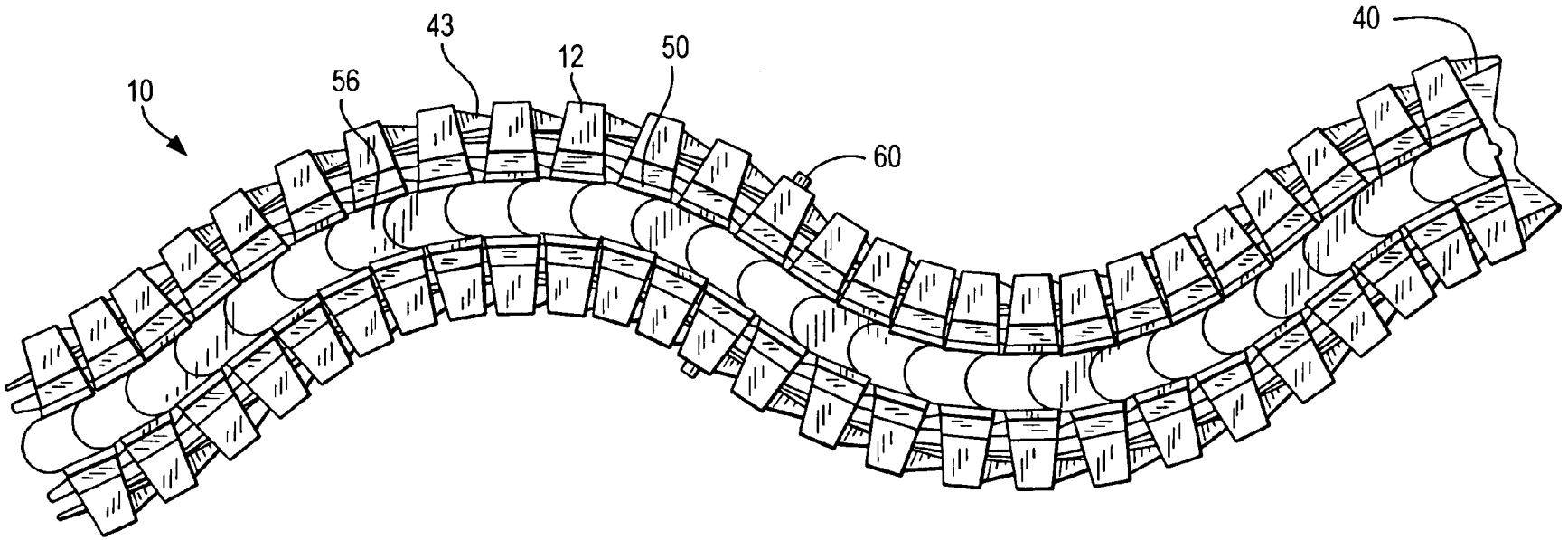
FIG. 1 is a top elevation view of a track in accordance with the invention.

FIG. 1 depicts an overall length of track 10 which includes a number of segments 12. The segment 12 is the basic building block of the invention. A length of track 10 is made up of segments 12 which are secured together in a manner which will be described below.

Segment 12 is shown in greater detail in FIGS. 2–5. Segment 12 has a small main body 13, which is preferably solid, and segment 12 preferably includes an upper layer 22 having a top side 22A and a bottom side 22B and a lower layer 24. Top side 22A forms the surface upon which a toy vehicle will be supported. Lower layer 24 is spaced apart from upper layer 22 and thus forms a cavity 25 which can receive portions of adjacent segments 12. Upper and lower layers 22 and 24 are thicker longitudinally at their center than at their edges (see, e.g, FIG. 4), which enable adjacent segments to be angled with respect to each other, as explained below.

Projecting from a forward position of segment 12 are prongs 26 and guides 28. Prongs 26 are substantially flat and help deter free and loose movement between adjacent segments as will be described below. Guides 28 impart stiffness to the track, particularly in upwardly or downwardly curved portions of the track.

Figure 3:
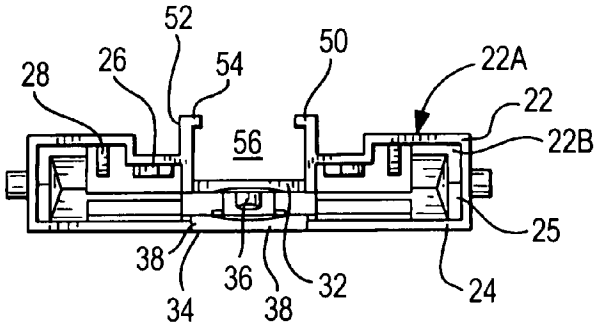
FIG. 3 is a front elevation view of the track segment of FIG. 2.
Figure 2:
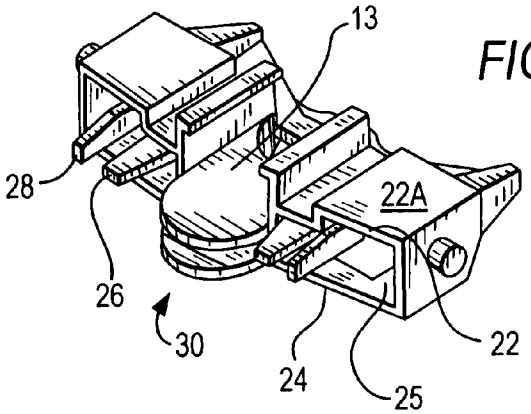
FIG. 2 is a perspective view of a track segment in accordance with the invention.
Figure 4:
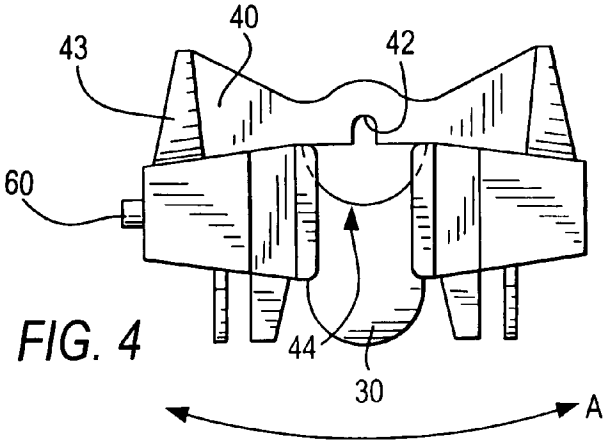
FIG. 4 is a top elevation view of the track segment of FIG. 2.
Figure 5:
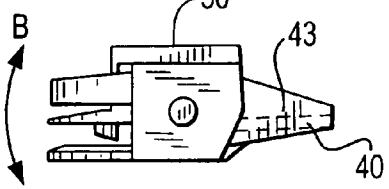
FIG. 5 is a side elevation view of the track segment of FIG. 2.
Figure 6:
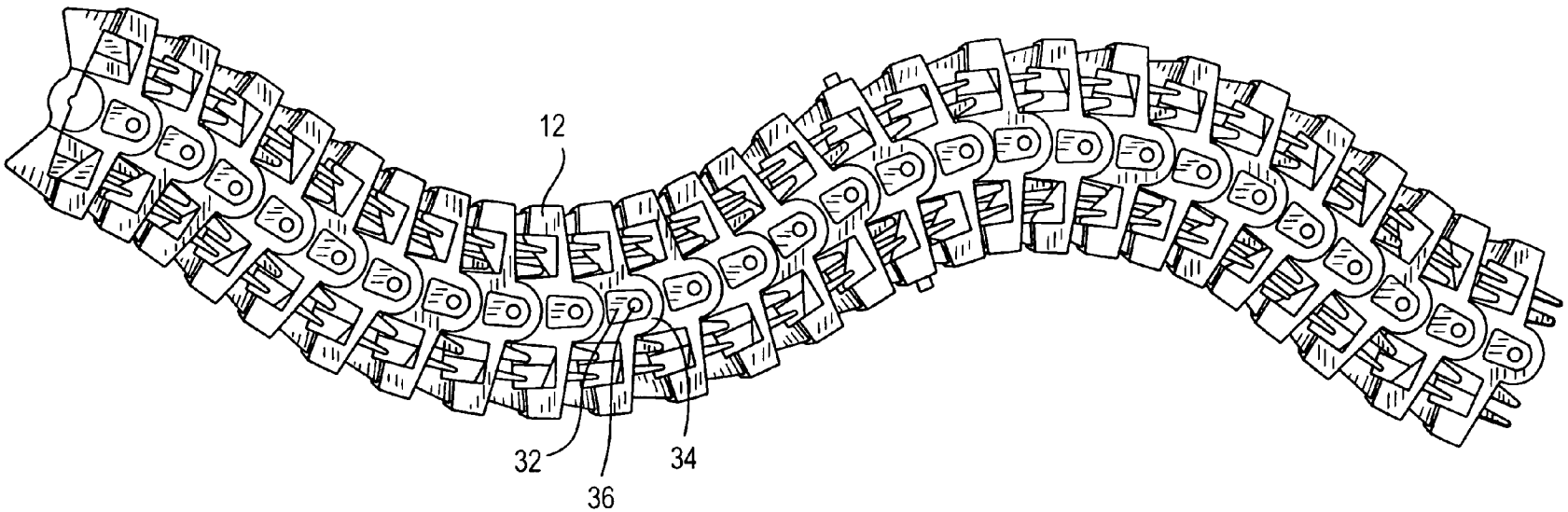
FIG. 6 is a bottom elevation view of the track of FIG. 1.

One segment 12 is secured to an adjacent segment 12 via tongue 30. Tongue 30 projects forwardly from segment 12 and is shown to be semicircular in profile. As best illustrated in FIGS. 2 and 3, tongue 30 includes an upper tongue portion 32 extending from upper layer 22 and a lower tongue portion 34 extending from lower layer 24. Pivot pin 36 hangs from an underside of upper tongue portion 32. Lower tongue portion 34 is preferably only a U-shaped rim (see FIG. 6) through which pivot pin 36 is visible from an underside view. By not making lower tongue portion 34 solid, the pivot joint is made more flexible. Lower tongue portion 34 is thicker (in the vertical direction) on its ends than in its center and includes projections 38 which rise up to approach upper tongue portion 32.

The rear portion of segment 12 is provided with a crossbar 40 preferably having a notch 42 cut therein. One segment 12 is attached to the next in the following manner. Crossbar 40 is pushed between upper tongue portion 32 and lower tongue portion 34. Pivot pin 36 rides along the upper surface of the adjacent segment's crossbar 40 until it snaps behind crossbar 40, preferably into notch 42. It is preferred that tongue portions 32 and 34 be made from a resilient material so that when the crossbar is inserted therein, the tongue portions are pushed apart, and when pivot pin 36 encounters notch 42 (or at least the forward edge of crossbar 40), the tongue portions snap back into their initial shapes. Side wedges 43 are also provided, and they pass into cavity 25 of a rearwardly adjacent segment 12 and help align the track even as it is curved. The provision of pivot pin 36 and notch 42, along with the trapezoidal shape of each side of segment 12, enables each segment to rotate about its pivot pin 36 in the left-right direction of arrow A (see FIG. 4). Each segment 12 is capable of a few degrees of relative lateral angular motion with respect to its neighbor, perhaps 10–15°. However, in the aggregate, a number of track segments can each be rotated in the same direction so as to provide a curve to the track. For example, in one embodiment, only 16 segments are required to turn the path of the track up to 180°. Since the first segment cannot be rotated relative to itself, there are 15 segment interfaces, each capable of 12° of relative rotation.

While it is desirable to make the inventive track flexible in its configuration, it is also desirable not to have the various segments loosely flopping around but rather to have the track retain its shape once set up by the user. To this end, prongs 26 provide for some stability for the configuration of the track. Specifically, prongs 26 of one segment 12 frictionally engage the bottom side 22B of upper layer 22 of a forwardly adjacent segment 12 and thereby prevent the free and uncontrolled relative rotational movement of one segment with respect to the next. With this mechanism, the track curvature will be substantially stable unless and until the user actively rotates one or more segments 12 with respect to their neighbors.

Main body 13 includes a cutout 44 disposed just in front of notch 42 of crossbar 40. Cutout 44 is shaped to conform to the profile of tongue 30 so that upper tongue portion 32 and lower tongue portion 34 of a given segment do not abut any other structure on top of or beneath tongue 30. As a result, each segment 12 can flex upwards and downwards with respect to an adjacent segment 12 in the direction of arrow B of FIG. 5. Again, each segment 12 is capable of only a few degrees of relative vertical angular motion with respect to its neighbor, however, in the aggregate, a number of track segments can each be rotated in the same direction so as to provide a curve to the track. Since there is no limit to the overall extent of curvature of the track, loops can be created, as well as twists (via torsional flexion of the track) and other gravity-defying shapes.

If the track can twist and turn, a mechanism must be provided to retain the vehicle on the track so that it does not fall off when upside-down under the track or hanging sideways next to the track. To this end, projecting from top side 22A of each segment 12 are two flanges 50, each having a substantially vertical section 52 and a substantially horizontal section 54. Flanges 50 define a channel 56 therebetween. Flanges 50 are preferably made from a resilient material and are designed to be pushed apart when a portion of the vehicle is pressed downward into channel 56.

Figure 8:
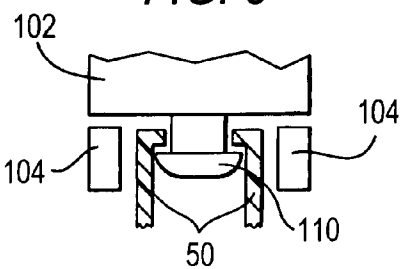
FIG. 8 is a sectional schematic view of a toy vehicle and track in accordance with the invention.
Figure 7:
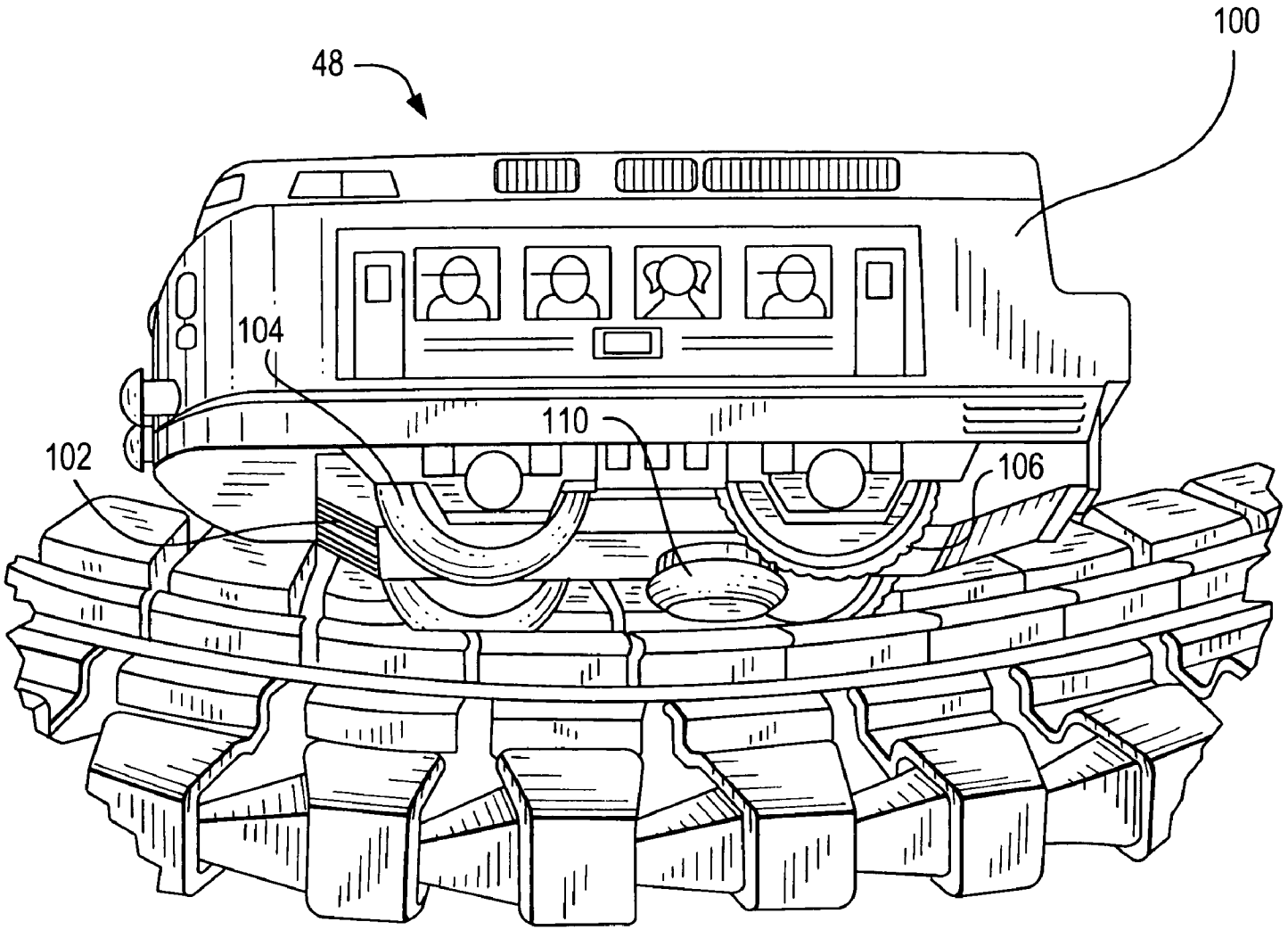
FIG. 7 is a perspective view of a toy vehicle in accordance with the invention.

A vehicle 98 in accordance with the invention is shown in perspective in FIG. 7 and in sectional schematic in FIG. 8. The vehicle includes an ornamental top portion 100 which, in this embodiment, is a train car. Disposed below the ornamental portion on its underside is a base 102 from which wheels 104 may be disposed. The vehicle 98 is supported on track 10 by wheels 104. An additional wheel or wheels 106 may be provided which propel vehicle 98 along track 10. That is, an on-board battery (not shown) causes wheel 106 to rotate and push off of track 10, thereby propelling the vehicle along the track. Propulsion wheel(s) 106 may be disposed on the side or sides of base 102 or in the center of base 102 and thus adapted to ride along channel 56.

Retaining knob 110 is provided in a substantially central portion of base 102, and it is designed to be snapped or otherwise forcibly disposed in channel 56. The width of retaining knob 110 is greater than the clearance between the opposing horizontal flange portions 54 of flanges 50. Thus, when the retaining knob 110 is pushed against resilient flanges 50, flanges 50 are pushed apart, and knob 110 is admitted into channel 56. Flanges 50 snap back and secure retaining knob 110 beneath horizontal flange portions 54 as shown in FIG. 8. Retaining knob 110 should have a necked-down portion which enables the horizontal flange portions 54 to return to their normal positions above retaining knob 110.

Figure 9:
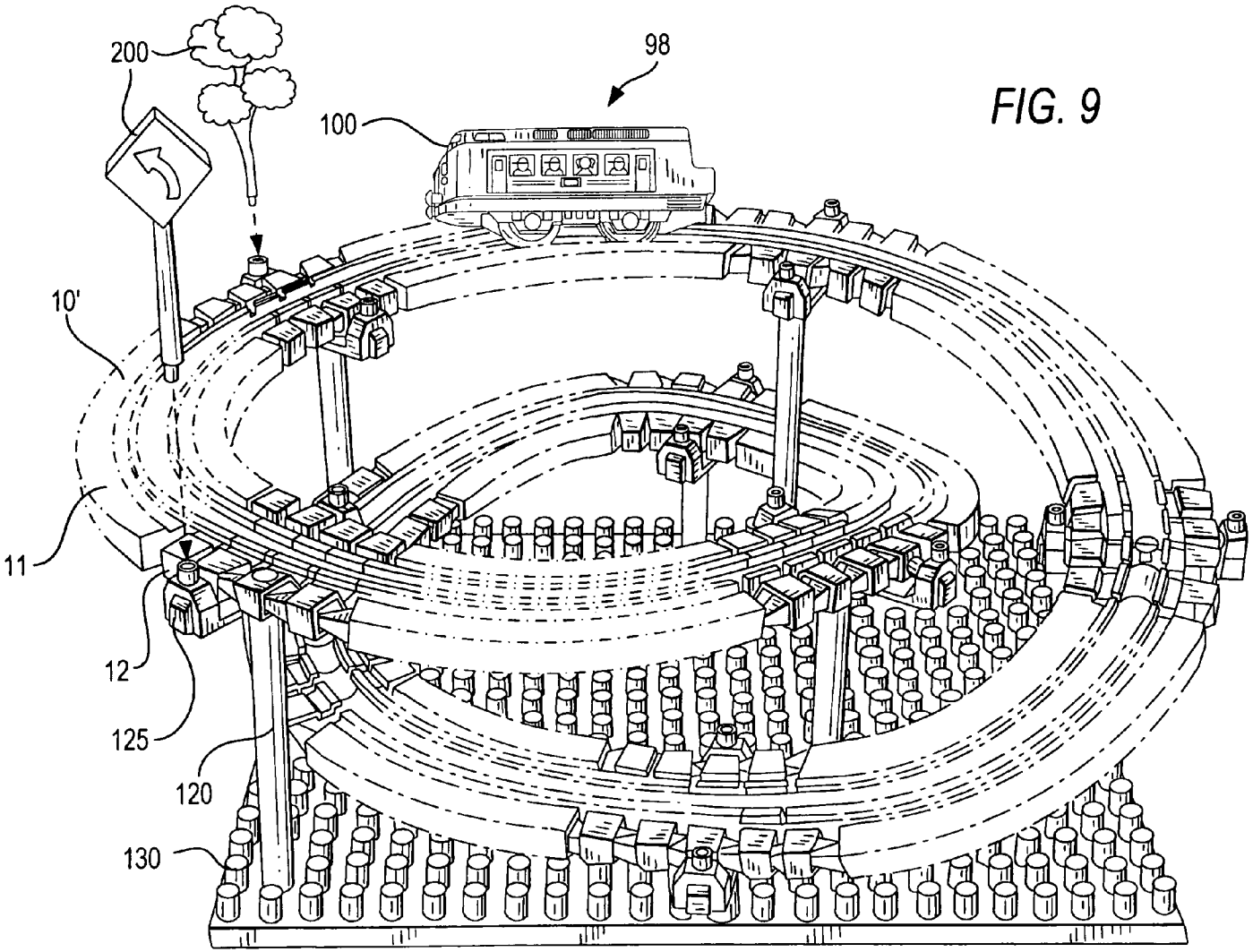
FIG. 9 is a perspective view of a toy train set incorporating the features of the invention.

An embodiment of a combination toy track and vehicle set is shown in FIG. 9. Track 10' is shown as having several sections 11 which are fixed in curvature but have a few segments 12 at one or both ends. Track 10' is supported in the air by columns 120 which attach at a top end to a trestle-like crossbeam 125 and at a bottom end to a planar surface 130. Columns are provided of differing heights so that the track 10' will rise and fall relative to surface 130. Crossbeams 125 attach to the track at pegs 60 (see FIGS. 2–4) which enable the track to be lifted from surface 130. Accessories 200 can be attached to crossbeams 125 for decorative purposes.

Figure 11:
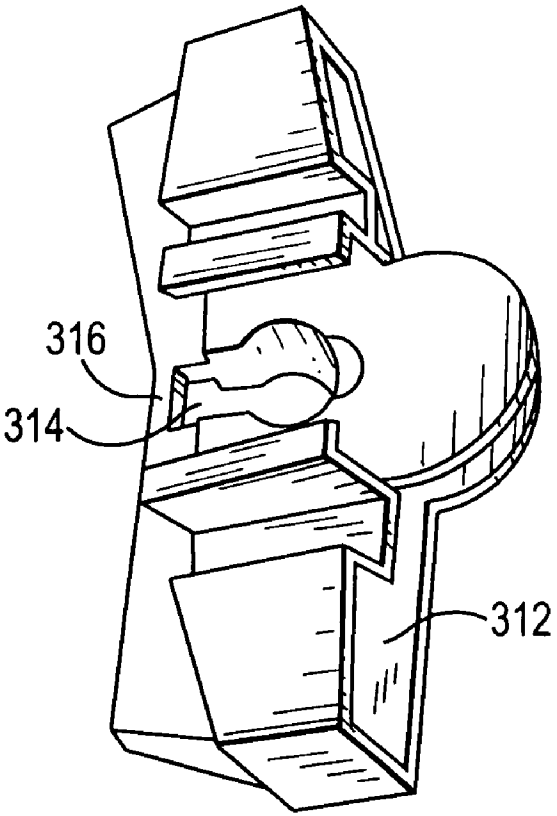
FIG. 11 is a perspective view of a female end track segment in accordance with the invention.
Figure 10:
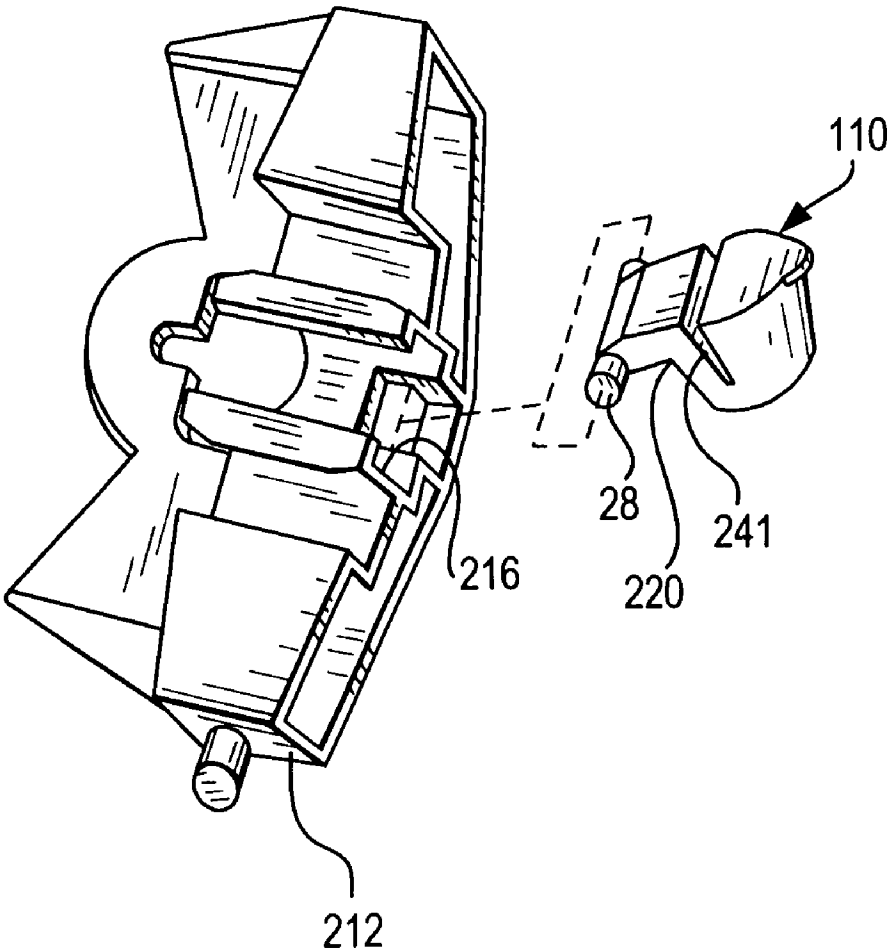
FIG. 10 is a perspective view of a male end track segment in accordance with the invention.
Figure 12A:
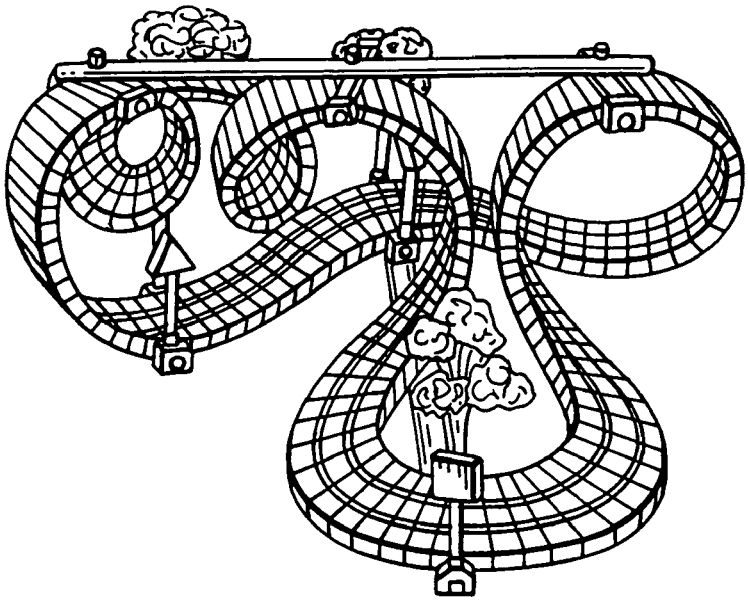
FIGS. 12A–B are perspective views of toy train sets incorporating the features of the invention.
Figure 12B:
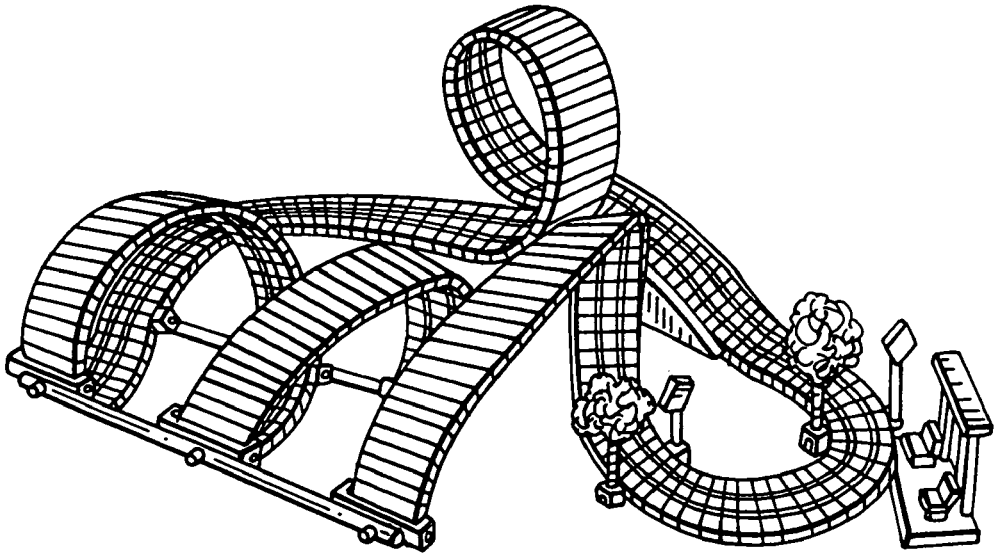

A track in accordance with the invention may be entirely comprised of segments 12 as they are all interchangeable. Not all segments 12 need be provided with pegs 60 for attachment to crossbeams 125 and/or accessories 200. Indeed, not all segments need be identical. For example, as shown in FIGS. 10 and 11, specialized terminal segments may be provided which allow for rapid and easy connection and disconnection of sections of track. FIG. 10 depicts a male end segment 212. Instead of a tongue 30 as described above, male end segment 212 includes a pin 214 which is securable in a cavity 216 via its pins 218. Female end segment 312 is provided with a modified cutout 314 which accommodates pin 214. Modified crossbar 316 catches behind the head of pin 214 at point 220.

The invention is not limited to the above description. For example, it is described above that the middle segments are completely separate but attachable to both the male and female segments to form a track. However, it is also contemplated that the inventive track come pre-assembled in a variety of sections each having a plurality of segments already attached to one another.

Also, the invention is described and shown using the terms "forward" and "rearward." However, it is understood that "forward" and "rearward" are relative terms simply meaning opposite ends of a given segment. What is important is that a tongue of one segment matingly engage with the crossbar of an adjacent segment. For example, all middle segments need not be identical; some middle segments may be provided with tongues on both ends interleaved or alternating with middle segments having mating crossbars on both ends.

Having described this invention with regard to specific embodiments, it is to be understood that the description is not meant as a limitation since further variations or modifications may be apparent or may suggest themselves to those skilled in the art. It is intended that the present application cover such variations and modifications, and the scope of the invention is defined by the claims appearing herein below.

What is claimed is:

1. A track for a toy vehicle having a plurality of connectable segments, each of said segments comprising:

an upper layer having a top side for supporting the toy vehicle and a bottom side;

a lower layer spaced apart from said upper layer;

a pivot pin vertically disposed on a forwardly projecting tongue attached to at least one of said upper or lower layers;

a rearwardly disposed crossbar adapted to receive said pivot pin of a separate yet immediate rearwardly adjacent segment; and forwardly projecting prongs adapted to engage a bottom side of a separate yet immediate forwardly adjacent segment, wherein friction between said prongs and said bottom side of said separate forwardly adjacent segment deters free relative motion between said separate yet immediate segments.

2. A track for a toy vehicle according to claim 1, further comprising a notch formed in a forward edge of said crossbar adapted to receive said pivot pin of an adjacent of said segments.

3. A track for a toy vehicle according to claim 1, said tongue further comprising:

an upper tongue portion projecting from said upper layer; and a lower tongue portion projecting from said lower layer aligned opposite said upper tongue portion, wherein said pivot pin projects from one of said upper tongue portion and lower tongue portion and wherein said crossbar is adapted to be secured between at least one of said upper tongue portion or lower tongue portion.

4. A track for a toy vehicle according to claim 3, further comprising projections formed on the other of said upper tongue portion and lower tongue portion opposite and on either side of said pivot pin.

5. A track for a toy vehicle according to claim 1, said prongs having a flat upper surface for engaging said bottom side of said upper layer of said adjacent segment.

6. A track for a toy vehicle according to claim 1, further comprising a pair of raised flanges projecting upward from said top side spaced apart to form a channel.

7. A track for a toy vehicle according to claim 6, wherein said channel is disposed over said tongue.

8. A track for a toy vehicle according to claim 7, further comprising a pre-assembled track portion made of a plurality of connected segments.

9. A track for a toy vehicle according to claim 6, said flanges further comprising:

a substantially vertical portion projecting from said top side of said track; and a substantially horizontal portion projecting over said channel.

10. A track for a toy vehicle according to claim 9, said flanges being made of a resilient material, wherein when a retaining knob from a toy vehicle is forcibly disposed into said channel, said flanges are pushed apart to allow the retaining knob into said channel and snap back to secure the retaining knob in said channel.

11. A track for a toy vehicle according to claim 6, said vehicle comprising:

a base;

wheels adapted to contact said top side of said track to allow said vehicle to roll on said track; and a retaining knob projecting from an underside of said base forcibly disposable in said channel, wherein when said retaining knob is forcibly disposed in said channel, said vehicle is retained on said track substantially regardless of angle of inclination or curvature of said track.

12. A track for a toy vehicle according to claim 1, further comprising side supports projecting from the sides of at least one of said segments, wherein said track is supportable above a planar surface at said side supports.

13. A track for a toy vehicle according to claim 1, further comprising a cutout formed in a rearward portion of each of said segments forward of the crossbar adapted to receive a tongue from a separate yet immediate rearward adjacent segment, wherein said tongue of said rearward adjacent segment can pivot up and down within said cutout.

14. A combination track and toy vehicle, comprising:

a track having a plurality of segments, each segment having:

an upper layer having a top side for supporting the toy vehicle and a bottom side;

a lower layer spaced apart from said upper layer;

a pivot pin vertically disposed on a forwardly projecting tongue attached to at least one of said upper or lower layers; and a rearwardly disposed crossbar adapted to receive said pivot pin of a separate yet immediate rearwardly adjacent segment; and a pair of raised flanges projecting upward from said top side spaced apart to form a channel; and said toy vehicle engageable with said track, having:

a base;

wheels adapted to contact said top side of said track to allow said vehicle to roll on said track; and a retaining knob projecting from an underside of said base forcibly disposable in said channel, wherein when said retaining knob is forcibly disposed in said channel, said vehicle is retained on said track substantially regardless of angle of inclination or curvature of said track.

15. A combination track and toy vehicle according to claim 14, said flanges further comprising:

a substantially vertical portion projecting from said top side of said track; and a substantially horizontal portion projecting over said channel.

16. A combination track and toy vehicle according to claim 15, said flanges being made of a resilient material, wherein when said retaining knob is forcibly disposed into said channel, said flanges are pushed apart to allow said retaining knob into said channel and snap back to secure said retaining knob in said channel.

17. A combination track and toy vehicle according to claim 14, further comprising a cutout formed in a rearward portion of each of said segments forward of the crossbar adapted to receive a tongue from a rearward adjacent segment, wherein said tongue of said rearward adjacent segment can pivot up and down within said cutout.

* * * * *